United States Patent [19]

Chen

[11] Patent Number: 4,930,708

[45] Date of Patent: Jun. 5, 1990

[54] GRINDING APPARATUS

[76] Inventor: Chi-Shiang Chen, No. 15, Chung-Shan Rd., Su-Ao Chen, Ilan Hsien, Taiwan

[21] Appl. No.: 370,685

[22] Filed: Jun. 23, 1989

[51] Int. Cl.[5] ..... B02C 7/08

[52] U.S. Cl. ..... 241/65; 241/250; 241/257 R; 241/261.1; 241/261.2

[58] Field of Search ..... 241/250, 257 R, 258, 241/259, 259.1, 65, 259.2, 66, 259.3, 67, 261.1, 261.2

[56] References Cited

U.S. PATENT DOCUMENTS

| | | | |
|---|---|---|---|
| 2,342,252 | 2/1944 | Claybourn et al. | 241/257 R |
| 2,573,709 | 11/1951 | Hill et al. | 241/257 R X |
| 4,081,146 | 3/1978 | Yagi | 241/259.3 X |
| 4,449,670 | 5/1984 | Tloczynski et al. | 241/259.3 X |

FOREIGN PATENT DOCUMENTS

| | | | |
|---|---|---|---|
| 262161 | 12/1926 | United Kingdom | 241/257 R |

*Primary Examiner*—Mark Rosenbaum

*Attorney, Agent, or Firm*—Harness, Dickey & Pierce

[57] ABSTRACT

A grinding apparatus includes a frame, a driving device mounted in the frame, and an upper and a lower grinding member mounted coaxially on a vertical axis on the frame. One of the upper and lower grinding members is rotated by the driving device. The upper grinding member is movable in an upward and a downward direction. Each of the upper and lower grinding members has a grinding disc with a central opening, a disc seat holding the grinding disc, and a shaft carrying the disc seat. The grinding surface of the grinding disc of the uper grinding member is concave and the grinding surface of the grinding disc of the lower grinding member is convex so that both of the grinding surfaces of the grinding discs can come into snug contact with each other. A guiding device is provided for guiding the shaft of the upper grinding member which permits the upper grinding member to move vertically but prevents the same from lateral movement. Therefore, the upper and lower grinding members have large contact surfaces for grinding.

6 Claims, 5 Drawing Sheets

GRINDING APPARATUS

BACKGROUND OF THE INVENTION

This invention relates to a grinding apparatus, more particularly to a grinding apparatus which has a large grinding surface.

Stone powders are widely used in architecture and civil engineering. These stone powders are generally made from rough stones by means of a grinding apparatus. A conventional grinding apparatus, such as that illustrated in FIG. 1, generally includes a body frame and a driving means (B) for driving a grinding seat (C) to rotate. In this illustrated grinding apparatus, two types of grinding wheels (D), (E) are shown. One type of said grinding wheel (D) has a truncated conical shape and rests on a flat grinding plate Cl mounted in the grinding seat (C). The other type of said grinding wheel (E) also has a truncated conical shape and rests on an arcuate grinding plate C2 which is mounted in the grinding seat (C). The grinding wheels (D), (E) are respectively and rotatably connected to the shafts D1, E1 which are in turn connected to the pivot arms D2, E2. The raw material to be ground, such as rough stones, is fed into the body frame (A) from two sides (F) of the body frame (A) so as to be ground between the grinding wheels (D), (E). In addition, air is blown into the body frame (A) via air tubes (G) mounted in the lower portion of the body frame (A) so as to enable the ground stone powder to be collected in a collecting hood (H) and a collecting pipe (P). However, the grinding wheels (D), (E) come in contact with only a very narrow, limited area of the flat grinding plate Cl, C2, thus adversely affecting the grinding efficiency. In addition, the scale of the grinding wheels of such a grinding apparatus is limited due to structural design factors. Hence, the weight of the grinding wheels is limited so that insufficient compression force is frequently exerted on the raw material to be ground during grinding process.

SUMMARY OF THE INVENTION

It is therefore a main object of this invention to provide a grinding apparatus which has two grinding members with large grinding surfaces which come in contact with each other and enhance the grinding efficiency thereof.

It is another object of this invention to provide a grinding apparatus which has large scale grinding members so as to increase the weight of the grinding members and the compression force exerted on the raw material to be ground.

Accordingly, a grinding apparatus of this invention includes a frame, a driving means mounted in the frame, and an upper and a lower grinding member mounted coaxially on a vertical axis on said frame. One of the upper and lower grinding members is rotated by the driving means. The upper grinding member is movable in an upward and a downward direction. Each of the upper and lower grinding members has a grinding disc with a central opening, a disc seat holding the grinding disc, and a shaft carrying the disc seat. The grinding surface of the upper grinding member is concave and the grinding surface of the lower grinding member is convex upward so that both of said grinding surface of said grinding discs can come into snug contact with each other. Means for guiding the shaft of the upper grinding member, which is mounted in said frame, permits the upper grinding member to move vertically but prevents the same member from lateral movement. Therefore, the upper and lower grinding members have large contacting surfaces for grinding. Moreover, the upper grinding member is large in scale so as to which can increase the compression force on the raw material to be ground.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 2:
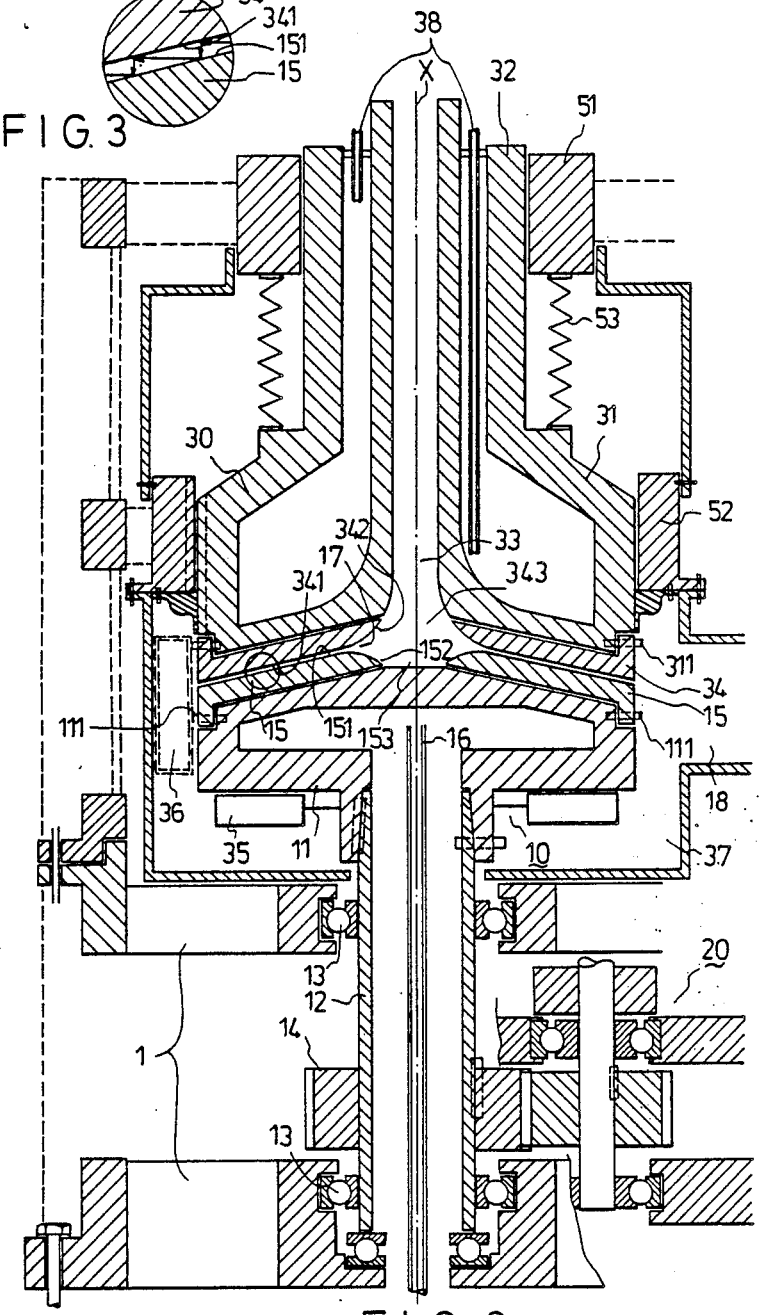
FIG. 2 is a sectional view of a first preferred embodiment of a grinding apparatus of this invention.

Referring to FIG. 2, a sectional view of a first preferred embodiment of a grinding apparatus is shown. The grinding apparatus comprises a frame 1, as well as an upper grinding member 30 and a lower grinding member 10 mounted coaxially on a vertical axis X of said frame 1. The lower grinding member 10 includes a grinding seat 11 which is associated with a shaft 12 and adapted to be rotated with the same. The shaft 12 is held in a vertical position in the frame 1 by the shaft bearings 13. A lower grinding disc 15 with a central opening 153 is fixed right above the grinding seat 11 by means of pins 111. The grinding disc 15 has a grinding face 151 and a round edge 152 adjacent the central opening 153 thereof. A cooling tube 16 extends into the grinding seat 11 for cooling purposes. A driving device 20, which is mounted in the frame 1 and adjacent to the lower grinding member 10, is adapted to drive a shaft gear 14 connected with the shaft 12 so that the lower grinding member 10 can be rotated with respect to the upper grinding member 30.

The upper grinding member 30 includes a grinding seat 31, a shaft 32 extended from the grinding seat 31 and a grinding disc 34 with a central opening 343 which is fixed to said grinding seat 31 by the pins 311. The shaft 32 and the guiding seat 31 of the upper grinding member 30 are supported by the supporting members 51, 52 which are fixed to the frame 1 and permit the upper guiding member 30 to move upwardly but not laterally. A feeding channel 33 is formed through the grinding seat 31 and the shaft 32 which communicates with the central opening 343 of the grinding disc 34. The grinding disc 34 has a grinding face 341 correspondingly in contact with the grinding face 151 of the grinding disc 15, and a round edge 342 adjacent the central opening 343 thereof. A compression spring 53 is interconnected between the grinding seat 31 and the supporting member 51 so as to urge the upper guiding member 30 to move toward the lower grinding member 10.

Figure 1:
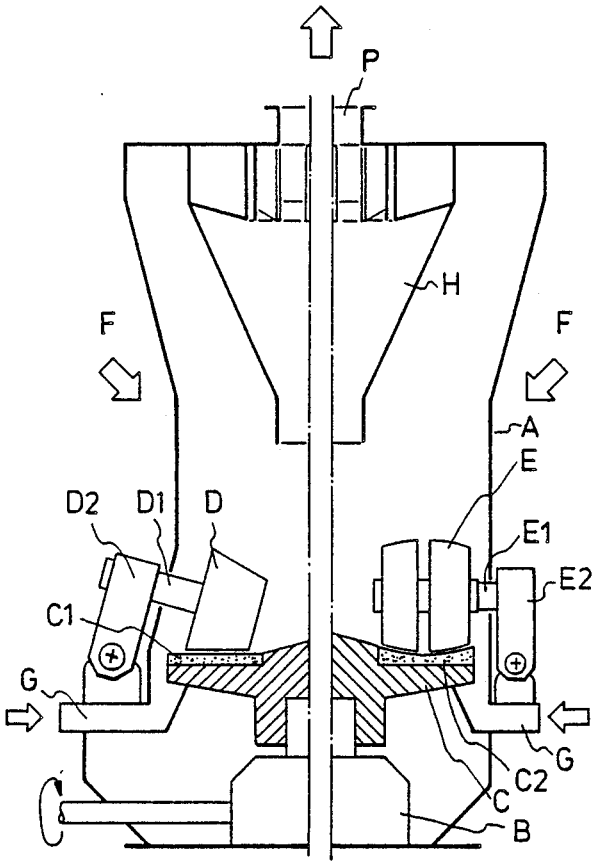
FIG. 1 (PRIOR ART)
FIG. 1 is a sectional schematic view of a conventional grinding apparatus.
Figure 3:
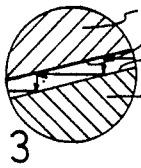
FIG. 3 is a enlarged schematic view of a portion of a grinding apparatus of FIG. 2, illustrating the moving path of a ground particle between the grinding discs of the grinding members of this invention during grinding process.

In operation, the driving device 20 is actuated to drive the lower grinding member 10 to rotate. The rough stones to be ground are then forced through the feeding channel 38 and into the arcuate jaw portion 17 which is defined by the round edges 152, 342 of the grinding discs 15, 34. In this way, the rough stones to be ground can be easily directed into the grinding area between the grinding faces 151, 341 of the upper and lower grinding members 10, 30 and ground thereat. The grinding surface of the grinding disc 15 of the lower grinding member 10 is concave and the grinding surface of the grinding disc 34 of the upper grinding member 30 is correspondingly convex so that the ground stone particles will move along a zigzag path in said grinding area, as best illustrated in FIG. 3, thus preventing said stone particles from being thrown out from said grinding area, thereby increasing the time during which said stone particles are ground. The grinding area between the upper and lower grinding members 30, 10 is apparently larger than that of a conventional grinding apparatus. Moreover, the upper grinding member 30 constantly exerts a downward pressure, which is caused by the weight of the upper grinding member 30 and the biasing force of the compression spring 53, on the grinding face 151 of the lower grinding member 10 so as to achieve an excellent grinding effect. It is noted that the upper grinding member 30 is large in scale so as to increase the compression force exerted on said stone particles to be ground. A fan 35 and an air discharging port 36 are provided for discharging the stone powder which has been ground by the upper and lower grinding members 30, 10 to through a powder outlet 18 and into a powder receiving chamber 37 provided for the collection of said powder.

Figure 4:
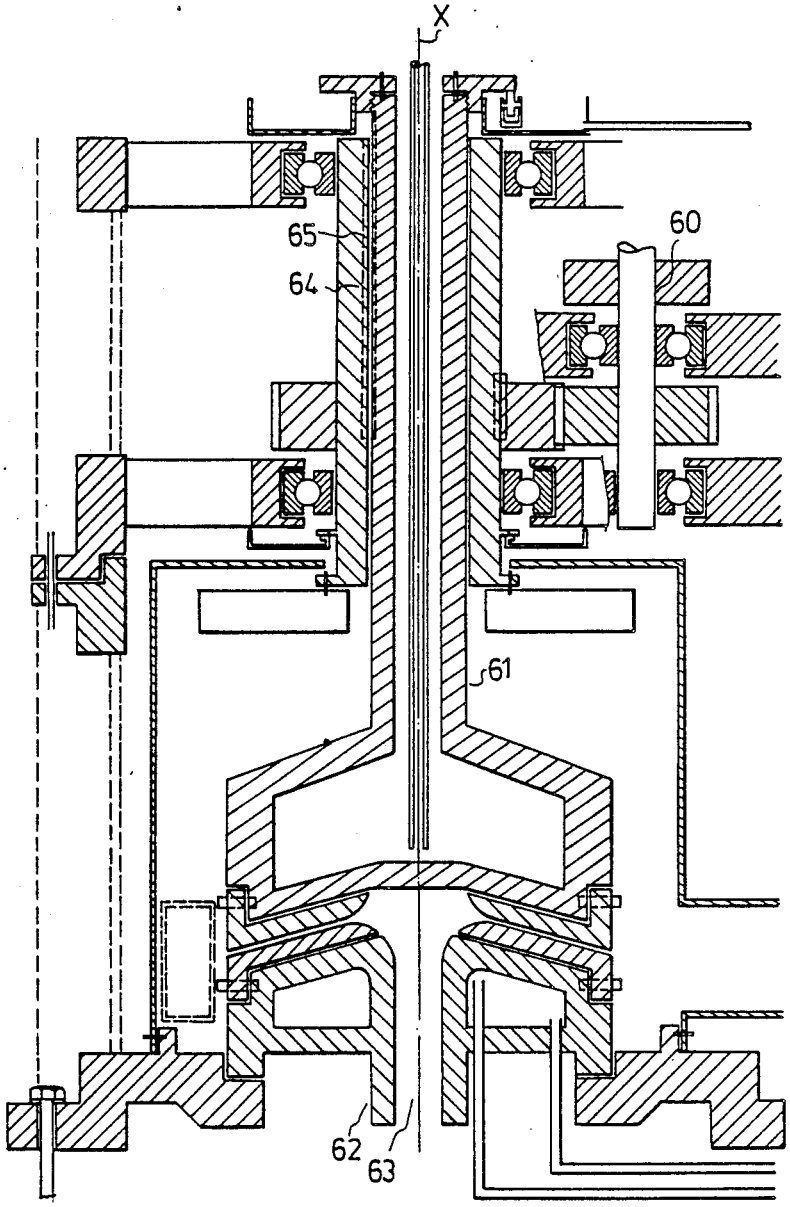
FIG. 4 is a sectional view of a second preferred embodiment of a grinding apparatus of this invention.

Referring to FIG. 4, a sectional view of a second preferred embodiment of a grinding apparatus is shown. The structure of this grinding apparatus is similar to that of the grinding apparatus of the first embodiment except that the upper grinding member 61 is driven by the driving device 60 which is mounted adjacent the upper grinding member 61, and the rough stones to be ground are forced through a feeding channel formed in the lower grinding member 62. The lower grinding member 62 is fixed in the frame. The upper grinding member 61 is held vertically by a sleeve member 64 which is journalled in the frame and driven to rotate by the driving device 60. The sleeve member 64 and the upper grinding member 61 are engaged with each other by means of the sliding chutes and sliding keys 65 provided therebetween so that the upper grinding member 61 can be rotated with the sleeve member 64 and can be guided to move vertically.

Figure 5:
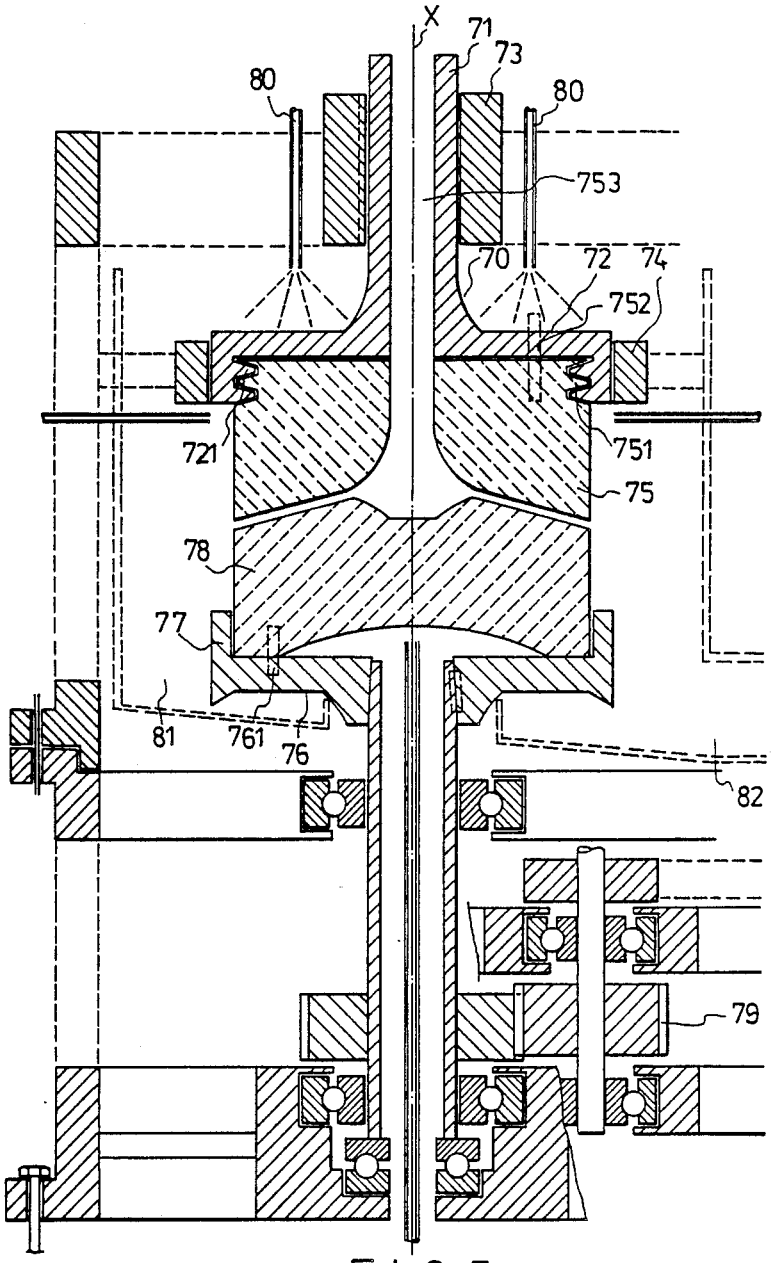
FIG. 5 is a sectional view of a third preferred embodiment of a grinding apparatus of this invention.

Referring to FIG. 5, a sectional view of a third preferred embodiment of a grinding apparatus is shown. In this embodiment, the upper and lower grinding members 70, 76 are arranged in the frame in a manner similar to those of FIG. 2. The shaft 71 and the grinding seat 72 of upper grinding member 70 are respectively supported by the supporting members 73, 74 in a manner similar to that of the grinding apparatus of the first embodiment so that the upper grinding member 70 can be guided in a manner similar to that of the first embodiment. The grinding seat 72 has a downward peripheral flange which is internally threaded 721. The grinding disc 75 of the upper grinding member 70 is externally threaded around the upper portion thereof so as to screw with the grinding seat 72 of the upper grinding member 70. In addition, said grinding seat 72 is positioned radially relative to said grinding disc 75 by means of a pin 752. The grinding disc 78 of the lower grinding member 76 is supported by a grinding seat 77 of the lower grinding member 76 and is positioned thereon by a pin 761. The lower grinding member 76 is driven to rotate with respect to the upper grinding member 70 by a driving device 79. A plurality of cooling tubes 80 are provided above the upper grinding member 70 so as to spray cool water on the grinding members for cooling purposes. The rough stones which are fed and passed through the feeding channel 753 will be ground into stone powder. The resulting stone powder will then be mixed with the cool water and passed out from an outlet 82 via a drain trough 81. The grinding discs 75, 78 are preferably made of marble so as to prevent the ground stone powder from mixing with metal powder which would be the result if metal grinding discs were used. Therefore, a good quality of the ground stone powder can be assured. Moreover, the grinding discs of the upper and lower grinding members can be easily replaced when the need arises.

Figure 6:
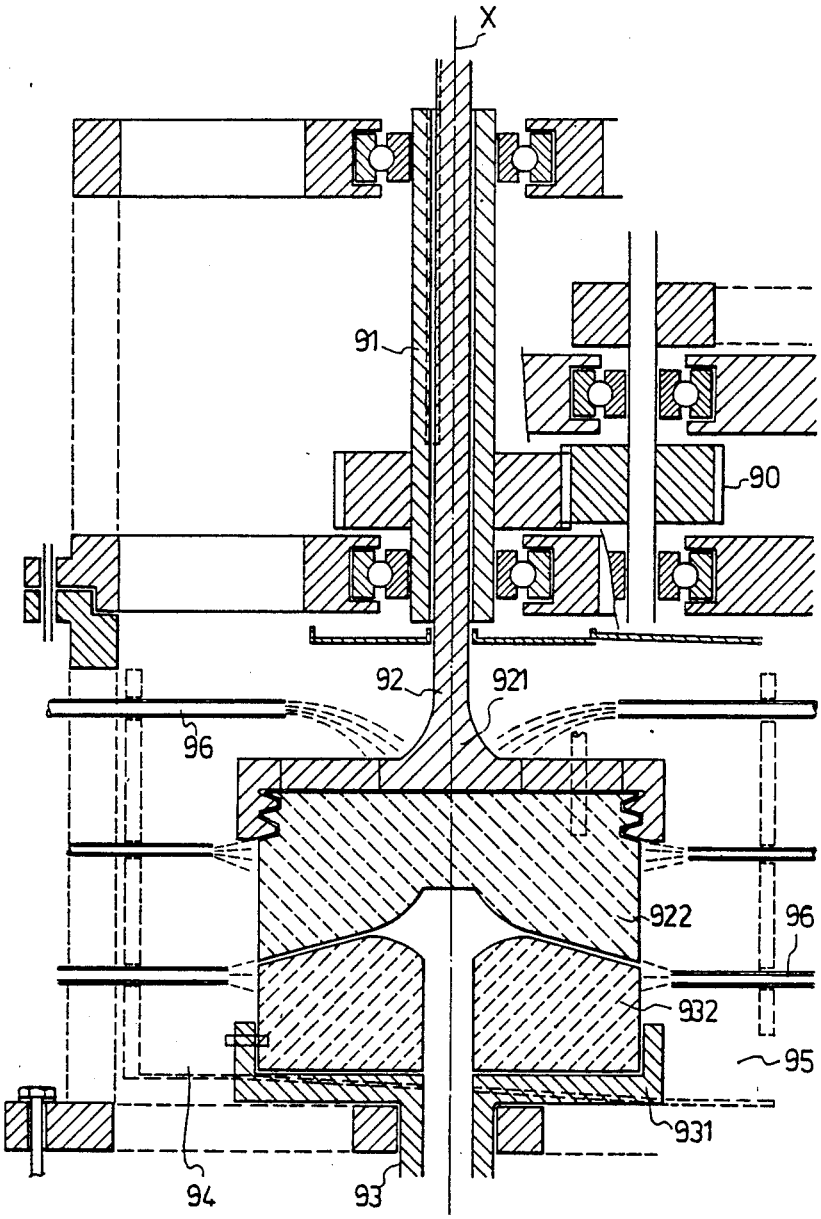
FIG. 6 is a sectional view of a fourth preferred embodiment of a grinding apparatus of this invention.

Referring to FIG. 6, a sectional view of a fourth preferred embodiment of a grinding apparatus is shown. In this embodiment, the upper grinding member 92 is supported by a sleeve member 91 in a manner similar to that of the second embodiment of this invention. The grinding seat 921 and the grinding disc 922 of the upper grinding member 92, as well as the grinding seat 931 and the grinding disc 932 of the lower grinding member 93, are engaged with each other in a manner similar to those of the third embodiment of this invention. The upper grinding member 92 is driven to rotate by means of a driving device 90 and the lower grinding member 93 is positioned on the frame of the grinding apparatus. A plurality of cooling tubes 96 are provided for spraying cool water to cool the upper and lower grinding members 92, 93 during the grinding process. The ground stone powder will be mixed with the cool water and passed out from an outlet 95 via a drain trough 94.

With this invention thus explained, it is apparent that numerous modifications and variations can be made without departing from the spirit and scope of this invention. It is therefore intended that this invention be limited only as indicated in the appended claims.

I claim:

1. A grinding apparatus comprising:

a supporting frame;

a driving means mounted in said frame;

an upper and a lower grinding member mounted coaxially on a vertical axis on said frame, one of said upper and lower grinding members being rotated by said driving means, said upper grinding member being movable in an upward and a downward direction, each of said upper and lower grinding members having a grinding disc with a central opening and a grinding surface, a disc seat holding each of said grinding discs, means for removably securing each of said grinding discs to respective of said disc seats, and respective shafts carrying each of said disc seats said grinding surface of said grinding disc of said upper grinding member being concave, said grinding surface of said grinding disc of said lower grinding member being convex so as to correspondingly come into contact with said grinding surface of said upper grinding member;

means for guiding said shaft of said upper grinding member, which permits said upper grinding member to move vertically but prevents the same from lateral movement; and a feeding channel formed through one of said grinding members which communicates with said central openings of said grinding discs.

2. A grinding apparatus as claimed in claim 1, wherein said grinding seats and said grinding discs are provided with round edges adjacent to said central openings of the grinding discs.

3. A grinding apparatus as claimed in claim 1 further comprising a spring member which is vertically interconnected between said disc seat of said upper grinding member and said frame, urging said upper grinding member to move toward said lower grinding member.

4. A grinding apparatus as claimed in claim 1, wherein said grinding disc of the upper grinding member is made of marble and has an externally threaded portion, and said disc seat of said upper grinding member is provided with an internally threaded portion so that said grinding disc of said upper grinding member can be screwed to said upper grinding member.

5. A grinding apparatus as claimed in claim 1 further comprising means for cooling said grinding discs of said upper and lower grinding members mounted in said frame.

6. A grinding apparatus as claimed in claim 1 further comprising a drain trough mounted in the supporting frame.

* * * * *